US005666667A

United States Patent [19]

Hook, Jr.

[11] Patent Number: 5,666,667

[45] Date of Patent: Sep. 16, 1997

[54] GRIP CONTROL GLOVE FOR A HANDGUN

[76] Inventor: Wilfred L. Hook, Jr., 2381 Haumana Pl., Honolulu, Hi. 96819

[21] Appl. No.: 551,706

[22] Filed: Nov. 1, 1995

[51] Int. Cl.[6] ..... A41D 19/00

[52] U.S. Cl. ..... 2/159; 2/161.5; 2/907

[58] Field of Search ..... 2/158, 159, 161.1, 2/161.5, 161.6, 162, 163, 907

[56] References Cited

U.S. PATENT DOCUMENTS

| | | | |
|---|---|---|---|
| 1,680,592 | 8/1928 | Chiles | 2/158 |
| 2,318,785 | 5/1943 | Kopplin | 2/158 |
| 2,609,543 | 9/1952 | Farrell | 2/158 |
| 3,608,093 | 9/1971 | Kirby | 2/163 |
| 4,523,348 | 6/1985 | Petrie | 2/158 |
| 4,564,956 | 1/1986 | DiBuono | 2/158 |
| 4,704,743 | 11/1987 | Thornell et al. | 2/163 |
| 4,754,498 | 7/1988 | Stinemates | 2/158 |

*Primary Examiner*—Michael A. Neas
*Attorney, Agent, or Firm*—Michael I. Kroll

[57] ABSTRACT

A grip control glove (10) for a handgun (12) comprising a covering (14) for a hand (16) of a person. The covering (14) has a pocket (18) therein, so that a middle finger (20), ring finger (22) and pinkie (24) of the hand (16) are bent back to grasp a handle (26) of the handgun (12) inserted into the pocket (18)) of the covering (14). An index trigger finger (28) and thumb (30) of the hand (16) will extend out of the pocket (18) of the covering (14) for freedom of movement to fire the handgun (16).

20 Claims, 3 Drawing Sheets

GRIP CONTROL GLOVE FOR A HANDGUN

BACKGROUND OF THE INVENTION

1. Field of the Invention

The instant invention relates generally to gloves and more specifically it relates to a grip control glove for a handgun.

2. Description of the Prior Art

Numerous gloves have been provided in prior art that are each a fitted covering for a hand with separate sections for each finger and thumb. While these units may be suitable for the particular purpose to which they address, they would not be as suitable for the purposes of the present invention as heretofore described.

SUMMARY OF THE INVENTION

A primary object of the present invention is to provide a grip control glove for a handgun that will overcome the shortcomings of the prior art devices.

Another object is to provide a grip control glove for a handgun which is basically a glove without fingers and wristband that will allow a hand of a person to better hold onto a handle of the handgun that is placed within the glove.

An additional object is to provide a grip control glove for a handgun that will not cover the index trigger finger and thumb of the hand, so as to maintain freedom of movement when the handgun is to be fired.

A further object is to provide a grip control glove for a handgun which will prevent the weapon from being wrestled away from the user.

Still a furhter object is to provide a grip control glove for a handgun which may also be used for assualt rifles with a similar grip.

A further object is to provide a grip control glove for a handgun that is simple and easy to use.

A still further object is to provide a grip control glove for a handgun that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
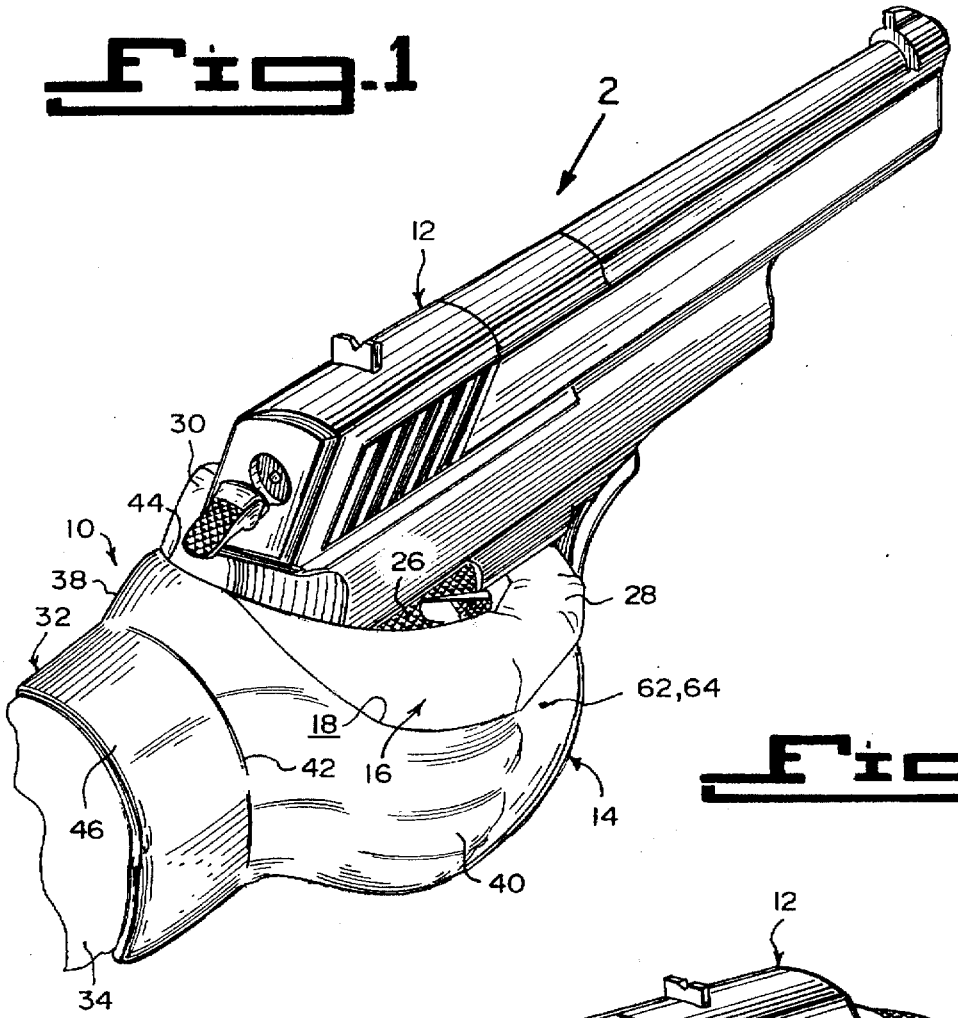
FIG. 1 is a perspective view of a first embodiment of the instant invention worn on a hand holding a handle of a handgun.
Figure 2:
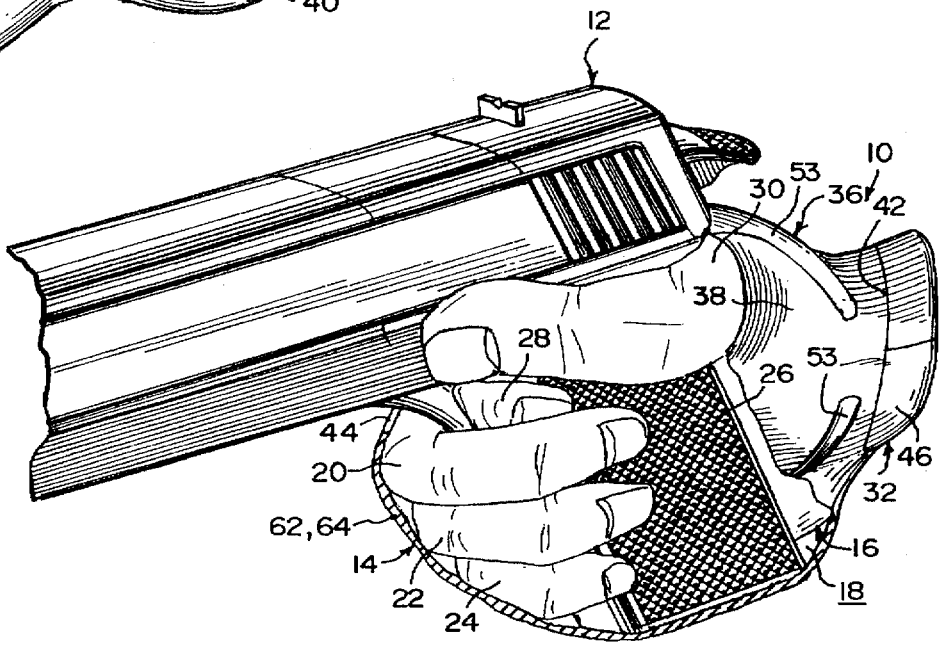
FIG. 2 is a perspective view taken in the direction of arrow 2 in FIG. 1, with parts broken away and in section.

Turning now descriptively to the drawings, in which similar reference characters denote similar elements throughout the several views, FIGS. 1 through 9 illustrate a grip control glove 10 for a handgun 12 comprising a covering 14 for a hand 16 of a person. The covering 14 has a pocket 18 therein, so that a middle finger 20, ring finger 22 and pinkie 24 of the hand 16 are bent back to grasp a handle 26 of the handgun 12 inserted into the pocket 18 of the covering 14. An index trigger finger 28 and thumb 30 of the hand 16 will extend out of the pocket 18 of the covering 14, for freedom of movement to fire the handgun 12.

The grip control glove 10 further includes a first structure 32, for securing the covering 14 to a wrist 34 of the hand 16 of the person. The hand 16 of the person will better hold onto the handle 26 of the handgun 12 that is inserted into the pocket 18 of the covering 14, to prevent accidental dropping of the handgun 12 when the person is running, especially over rough terrain.

A second structure 36 is for securing the covering 14 to the wrist 34 of the hand 16 of the person. The hand 16 of the person will increase the hold onto the handle 26 of the handgun 12 that is inserted into the pocket 18 of the covering 14, so as to allow the person to relax the hold onto the handle 26 periodically, rest and still have the hand 16 secured to the handle 26 of the handgun 12.

The covering 14 contains a palm portion 38 and a back hand portion 40 forming an open cuff 42 and an open top mouth 44 in the covering 14. The hand 16 of the person can be inserted through the open cuff 42 into the pocket 18. The handle 26 of the handgun 12 can be inserted through the open top mouth 44 into the pocket 18, so that the middle finger 20, ring finger 22 and pinkie 24 of the hand 16 can grasp the handle 26 of the handgun 12.

The first securing structure 32 consists of a wristband 46 divided into two parts which are integral with the covering 14, so that said wristband 46 can wrap about the wrist 34 of the hand 16 of the person. Components 48 are for fastening free ends of the wristband 46 together after the wristband 46 is wrapped about the wrist 34 of the hand 16 of the person.

Figure 3:
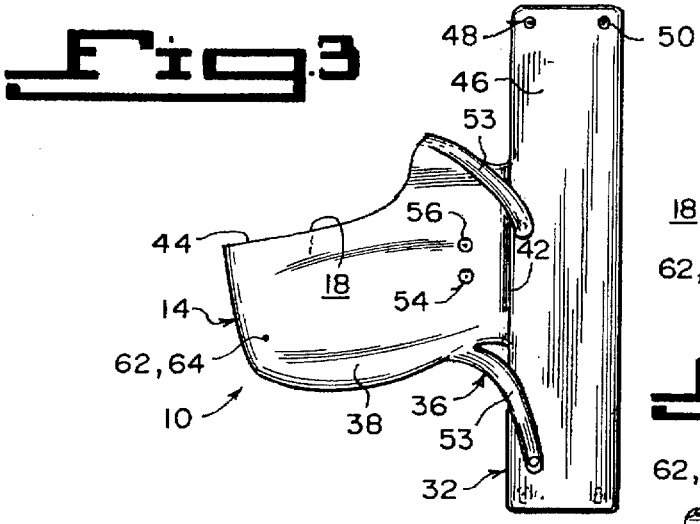
FIG. 3 is a side view of the first embodiment per se before installed on the hand.
Figure 4:
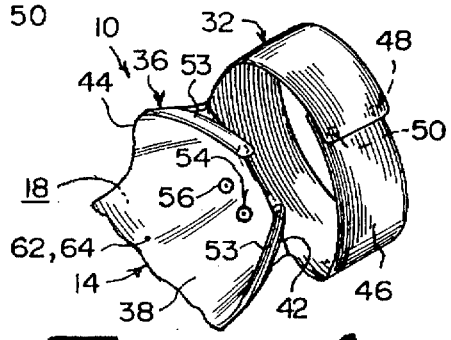
FIG. 4 is a perspective view of the first embodiment per se with parts broken away and the wristband in its closed position.
Figure 5:
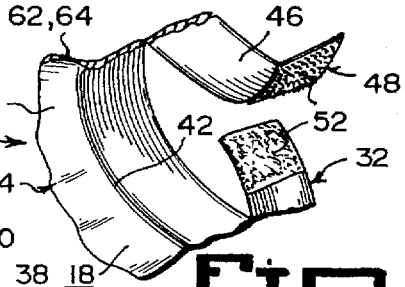
FIG. 5 is a perspective view with parts broken away and in section, showing a VELCRO fastener for the wristband.

The fastening components 46, as shown in FIGS. 3 and 4, are a plurality of snap fasteners 50 located at the free ends of the wristband 46. The fastening components 48, as shown in FIG. 5 are VELCRO (hook and looptype) fasteners 52, located at the free ends of the wristband 46.

The second securing structure 36 comprises a pair of wrist straps 53, which are integral with the covering 14 adjacent the wrist 34 of the hand 16 of the person. Elements 54 are for fastening free ends of the wrist straps 53 to the palm portion 38 of the covering 14. The fastening elements 54 are a plurality of snap fasteners 56, located at the free ends of the wrist straps 53 and the palm portion 38 of the covering 14.

Figure 6:
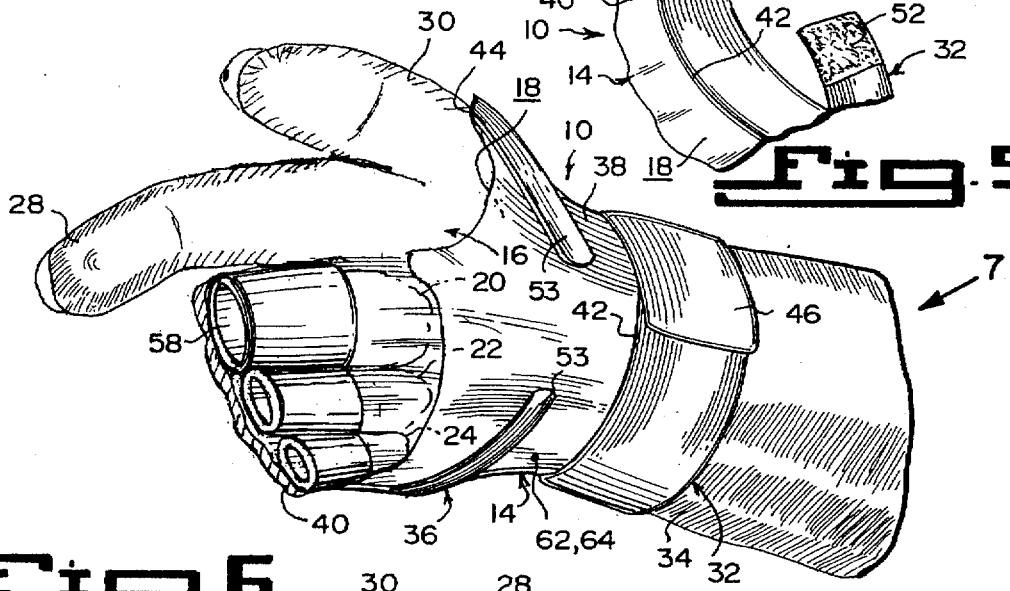
FIG. 6 is a perspective view of a second embodiment of the instant invention worn on a hand, with parts broken away and in section.
Figure 7:
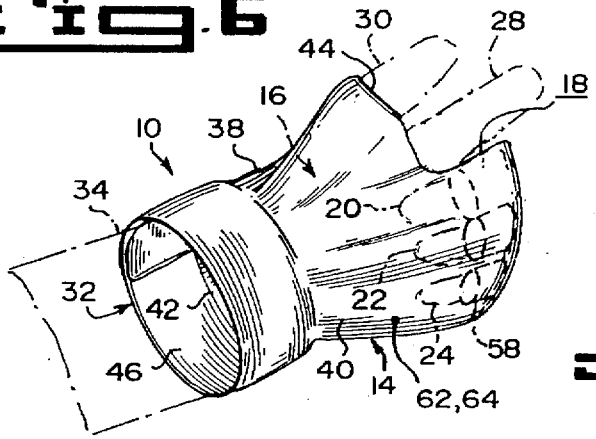
FIG. 7 is a perspective view taken in the direction of arrow 7 in FIG. 6, with the hand shown in phantom.
Figure 8:
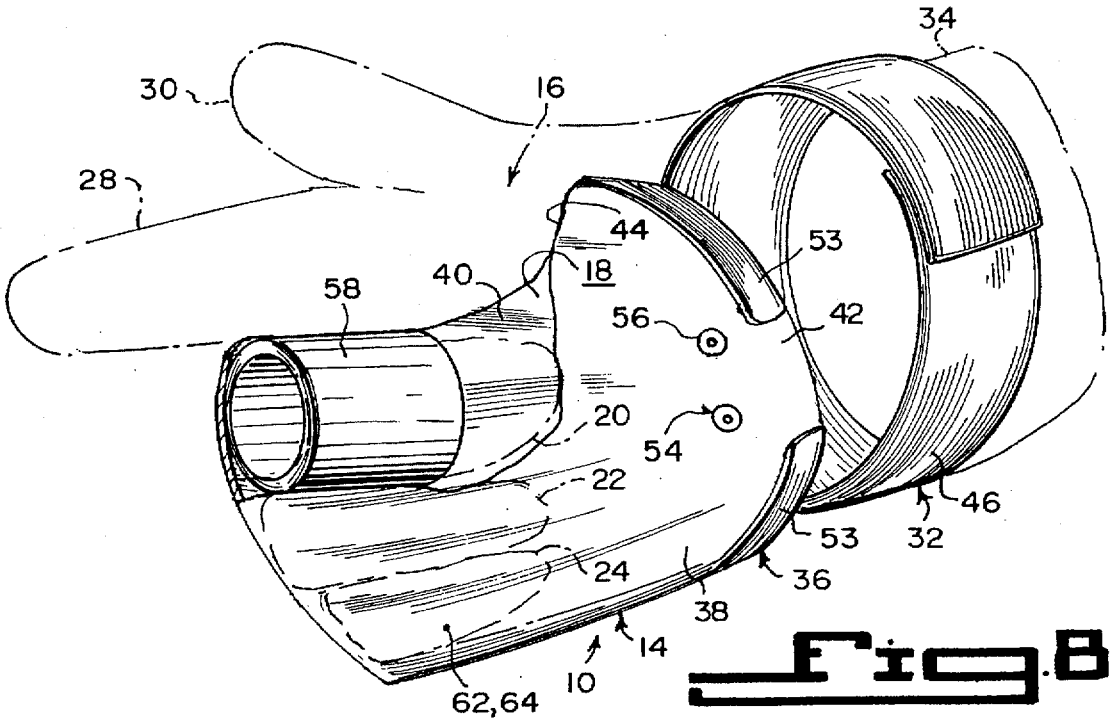
FIG. 8 is a perspective view of a third embodiment of the instant invention with parts broken away and in section, worn on a hand that is shown in phantom.

In FIGS. 6 and 7, three finger sleeves 58 are each placed onto the middle finger 20, ring finger 22 and pinkie 24 of the hand 16. When the fingers are bent back to grasp the handle 26 of the handgun 12 within the pocket 18 of the covering 14, the finger sleeves 58 will cushion the fingers and act as a non-slip grip when perspiration develops within the covering 14. In FIG. 8, a finger sleeve 58 is placed onto the middle finger 20 of the hand 16. When the middle finger 20 is bent back to grasp the handle 26 of the handgun 12 within the pocket 18 of the covering 14, the finger sleeve 58 will cushion the middle finger 20 and act as a non-slip grip when perspiration develops within said covering 14.

Figure 9:
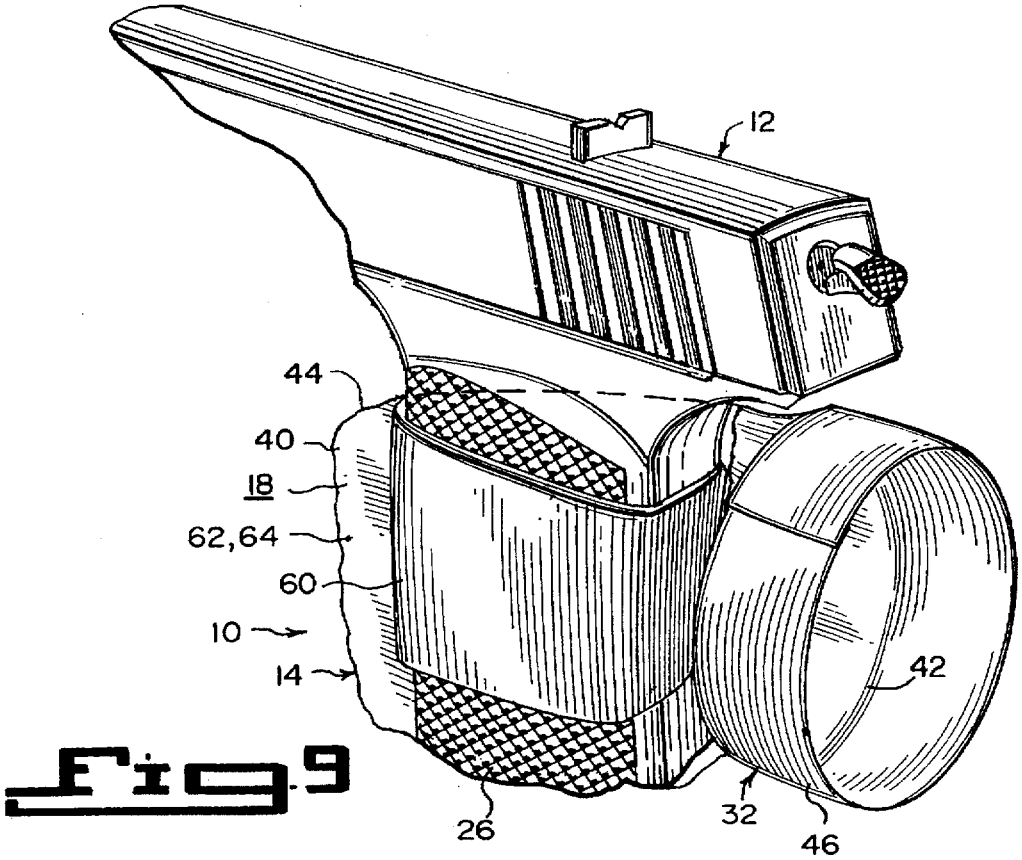
FIG. 9 is a perspective view of a fourth embodiment of the instant invention with parts broken away and in section, showing the handle of the handgun carried in a sheath therein and the hand removed therefrom.

FIG. 9 shows a stretchable sheath 60, to receive the handle 26 of the handgun 12. The sheath 60 will provide for a better grip onto the handle 26 by the middle finger 20, ring finger 22 and pinkie 24 of the hand 16 of the person, when the handle 26 of the handgun 12 with the sheath 60 is inserted into the pocket 18 of the covering 14. The covering 14 can be fabricated out of leather material 62. The covering 14 can also be fabricated out of nylon material 64.

LIST OF REFERENCE NUMBERS

| | |
|---|---|
| 10 | grip control glove |
| 12 | handgun |
| 14 | covering of 10 |
| 16 | hand |
| 18 | pocket in 14 |
| 20 | middle finger of 16 |
| 22 | ring finger of 16 |
| 24 | pinkie of 16 |
| 26 | handle of 12 |
| 28 | index trigger finger of 16 |
| 30 | thumb of 16 |
| 32 | first securing structure |
| 34 | wrist of 16 |
| 36 | second securing structure |
| 38 | palm portion of 14 |
| 40 | back hand portion of 14 |
| 42 | open cuff in 14 |
| 44 | open top mouth in 14 |
| 46 | wristband of 32 |
| 48 | fastening component of 32 |
| 50 | snap fastener for 48 |
| 52 | VELCRO fastener |
| 53 | wrist strap of 36 |
| 54 | fastening element |
| 56 | snap fastener for 54 |
| 58 | finger sleeve |
| 60 | stretchable sheath |
| 62 | leather material for 14 |
| 64 | nylon material for 14 |

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A grip control glove for a handgun comprising a) a covering for a hand of a person, said covering having a pocket therein so that a middle finger, ring finger and pinkie of the hand are bent back to grasp a handle of the handgun inserted into the pocket of said covering, while an index trigger finger and thumb of the hand will extend out of the pocket of said covering for freedom of movement to fire the handgun, and b) a stretchable sheath to receive the handle of the handgun, so as to provide for a better grip onto the handle by the middle finger, ring finger and pinkie of the hand of the person, when said handle of the handgun with said sheath is inserted into the pocket of the covering.

2. A grip control glove for a handgun as recited in claim 1, further including a first means for securing said covering to a wrist of the hand of the person, so that the hand of the person will better hold onto the handle of the handgun that is inserted into the pocket of said covering, to prevent accidental dropping of the handgun when the person is running, especially over rough terrain.

3. A grip control glove for a handgun as recited in claim 2, further including a second means for securing said covering to the wrist of the hand of the person, so that the hand of the person will increase the hold onto the handle of the handgun that is inserted into the pocket of said covering, so as to allow the person to relax the hold onto the handle periodically, rest and still have the hand secured to the handle of the handgun.

4. A grip control glove for a handgun as recited in claim 1, wherein said covering includes a palm portion and a back hand portion forming an open cuff and an open top mouth in the covering, so that the hand of the person can be inserted through the open cuff into the pocket, while the handle of the handgun can be inserted through the open top mouth into the pocket, so that the middle finger, ring finger and pinkie of the hand can grasp the handle of the handgun.

5. A grip control glove for a handgun as recited in claim 2, wherein said first securing means includes:

a) a wristband divided into two parts which are integral with said covering, so that said wristband can wrap about the wrist of the hand of the person; and b) means for fastening free ends of said wristband together after said wristband is wrapped about the wrist of the hand of the person.

6. A grip control glove for a handgun as recited in claim 5, wherein said fastening means includes a plurality of snap fasteners located at the free ends of said wristband.

7. A grip control glove for a handgun as recited in claim 5, wherein said fastening means includes hook and looptype fasteners located at the free ends of said wristband.

8. A grip control glove for a handgun as recited in claim 1, further including three finger sleeves each placed onto the middle finger, ring finger and pinkie of the hand, so that when the fingers are bent back to grasp the handle of the handgun within the pocket of said covering, said finger sleeves will cushion the fingers and act as a non-slip grip when perspiration develops within said covering.

9. A grip control glove for a handgun as recited in claim 1, further including a finger sleeve placed onto the middle finger of the hand, so that when the middle finger is bent back to grasp the handle of the handgun within the pocket of said covering, said finger sleeve will cushion the middle finger and act as a non-slip grip when perspiration develops within said covering.

10. A grip control glove for a handgun as recited in claim 1, wherein said covering is fabricated out of leather material.

11. A grip control glove for a handgun as recited in claim 1, wherein said covering is fabricated out of nylon material.

12. A grip control glove for a handgun comprising:

a) a covering for a hand of a person, said covering having a pocket therein so that a middle finger, ring finger and pinkie of the hand are bent back to grasp a handle of the handgun inserted into the pocket of said covering, while an index trigger finger and thumb of the hand will extend out of the pocket of said covering for freedom of movement to fire the handgun;

b) a first means for securing said covering to a wrist of the hand of the person, so that the hand of the person will better hold onto the handle of the handgun that is inserted into the pocket of said covering, to prevent accidental dropping of the handgun when the person is running, especially over rough terrain; and c) a second means for securing said covering to the wrist of the hand of the person, so that the hand of the person will increase the hold onto the handle of the handgun that is inserted into the pocket of said covering, so as to allow the person to relax the hold onto the handle periodically, rest and still have the hand secured to the handle of the handgun, said second means including i) a pair of wrist straps which are integral with said covering adjacent the wrist of the hand of the person; and ii) means for fastening free ends of said wrist straps to the palm side of said covering.

13. A grip control glove for a handgun as recited in claim 12, wherein said fastening means includes a plurality of snap fasteners located at the free ends of said wrist straps and the palm portion of said covering.

14. A grip control glove for a handgun comprising:

a) a covering for a hand of a person, said covering including:

i) a palm portion and a back hand portion forming an open cuff and an open top mouth in the covering: and ii) a pocket so that the hand of the person can be inserted through the open cuff into the pocket, while the handle of the handgun can be inserted through the open top mouth into the pocket, so that a middle finger, ring finger and pinkie of the hand are bent back to grasp a handle of the handgun inserted into the pocket of said covering, while an index trigger finger and thumb of the hand will extend out of the pocket of said covering for freedom of movement to fire the handgun;

b) a first means for securing said covering to a wrist of the hand of the person, so that the hand of the person will better hold onto the handle of the handgun that is inserted into the pocket of said covering, to prevent accidental dropping of the handgun when the person is running, especially over rough terrain; and c) a second means for securing said covering to the wrist of the hand of the person, so that the hand of the person will increase the hold onto the handle of the handgun that is inserted into the pocket of said covering, so as to allow the person to relax the hold onto the handle periodically, rest and still have the hand secured to the handle of the handgun, said second means including i) a pair of wrist straps which are integral with said covering adjacent the wrist of the hand of the person; and ii) means for fastening free ends of said wrist straps to the palm side of said covering.

15. A grip control glove for a handgun as recited in claim 14, wherein said fastening means includes a plurality of snap fasteners located at the free ends of said wrist straps and the palm portion of said covering.

16. A grip control glove for a handgun as recited in claim 15, further including three finger sleeves each placed onto the middle finger, ring finger and pinkie of the hand, so that when the fingers are bent back to grasp the handle of the handgun within the pocket of said covering, said finger sleeves will cushion the fingers and act as a non-slip grip when perspiration develops within said covering.

17. A grip control glove for a handgun as recited in claim 15, further including a finger sleeve placed onto the middle finger of the hand, so that when the middle finger is bent back to grasp the handle of the handgun within the pocket of said covering, said finger sleeve will cushion the middle finger and act as a non-slip grip when perspiration develops within said covering.

18. A grip control glove for a handgun as recited in claim 15, further including a stretchable sheath to receive the handle of the handgun, so as to provide for a better grip onto the handle by the middle finger, ring finger and pinkie of the hand of the person, when said handle of the handgun with said sheath is inserted into the pocket of the covering.

19. A grip control glove for a handgun as recited in claim 15, wherein said covering is fabricated out of leather material.

20. A grip control glove for a handgun as recited in claim 15, wherein said covering is fabricated out of nylon material.

* * * * *